US009957084B2

(12) United States Patent
Burkardt et al.

(10) Patent No.: US 9,957,084 B2
(45) Date of Patent: May 1, 2018

(54) TRANSPORT PACKAGING FOR PACKAGING HAZARDOUS MATERIALS

(71) Applicant: Roche Diagnostics Operations, Inc., Indianapolis, IN (US)

(72) Inventors: Holger Burkardt, Waldsee (DE); Gerd Fink, Mannheim (DE); Norbert Frisch, Mannheim (DE); Karl-Heinz Goebel, Lampertheim (DE)

(73) Assignee: Roche Diagnostics Operations, Inc., Indianapolis, IN (US)

( * ) Notice: Subject to any disclaimer, the term of this patent is extended or adjusted under 35 U.S.C. 154(b) by 368 days.

(21) Appl. No.: 14/277,291

(22) Filed: May 14, 2014

(65) Prior Publication Data

US 2014/0246347 A1 Sep. 4, 2014

Related U.S. Application Data

(63) Continuation of application No. PCT/EP2012/072750, filed on Nov. 15, 2012.

(30) Foreign Application Priority Data

Nov. 18, 2011 (EP) ..... 11189665

(51) Int. Cl.
*B65D 19/00* (2006.01)
*B65D 19/02* (2006.01)
(Continued)

(52) U.S. Cl.
CPC ..... *B65D 19/02* (2013.01); *B65D 5/505* (2013.01); *B65D 19/06* (2013.01); *B65D 71/02* (2013.01);
(Continued)

(58) Field of Classification Search
CPC ..... B65D 18/02; B65D 19/06; B65D 5/505; B65D 2519/00029; B65D 2519/00034;
(Continued)

(56) References Cited

U.S. PATENT DOCUMENTS 3,357,628 A * 12/1967 Fish ..... B65D 19/20 206/599
4,027,794 A * 6/1977 Olson ..... B65D 5/5095 206/386
(Continued)

FOREIGN PATENT DOCUMENTS

CN 2719751 Y 8/2005
CN 2792963 Y 7/2006
(Continued)

OTHER PUBLICATIONS

International Search Report dated Feb. 6, 2013, in Application No. PCT/EP2012/072750, 3 pages.

*Primary Examiner* — Luan K Bui
(74) *Attorney, Agent, or Firm* — Roche Diagnostics Operations, Inc.

(57) ABSTRACT

Disclosed is a transport packaging unit for packaging articles to be transported, in particular hazardous materials. The transport packaging unit comprises the following:

- a pallet with a base plate, wherein the articles to be transported are receivable on the base plate;
- a transport box which is open toward the base plate, wherein the transport box rests on the base plate and together with the base plate forms an interior of the transport packaging unit which receives the articles to be transported, wherein the transport box is fixed on the base plate by means of at least one fastening element, preferably by means of at least one packing strip.

12 Claims, 4 Drawing Sheets

(51) Int. Cl.
*B65D 19/06* (2006.01)
*B65D 5/50* (2006.01)
*B65D 71/02* (2006.01)

(52) U.S. Cl.
CPC ..... *B65D 2519/00029* (2013.01); *B65D 2519/00034* (2013.01); *B65D 2519/00064* (2013.01); *B65D 2519/0091* (2013.01); *B65D 2519/00099* (2013.01); *B65D 2519/00159* (2013.01); *B65D 2519/00194* (2013.01); *B65D 2519/00273* (2013.01); *B65D 2519/00288* (2013.01); *B65D 2519/00293* (2013.01); *B65D 2519/00323* (2013.01); *B65D 2519/00333* (2013.01); *B65D 2519/00373* (2013.01); *B65D 2519/00497* (2013.01); *B65D 2519/00562* (2013.01); *B65D 2519/00572* (2013.01); *B65D 2519/00597* (2013.01); *B65D 2519/00641* (2013.01); *B65D 2519/00661* (2013.01); *B65D 2519/00726* (2013.01)

(58) Field of Classification Search
CPC ..... B65D 2519/00323; B65D 2519/00562; B65D 2519/00572; B65D 71/02
USPC ..... 206/386, 599, 600; 108/55.1, 55.3
See application file for complete search history.

(56) References Cited

U.S. PATENT DOCUMENTS

| | | | | |
|---|---|---|---|---|
| 4,932,545 | A | 6/1990 | Sweet et al. | |
| 5,704,487 | A * | 1/1998 | Taravella | B65D 19/20 206/599 |
| 5,823,349 | A * | 10/1998 | Bridges | B65D 19/20 206/386 |
| 6,044,974 | A * | 4/2000 | Webb | B65D 65/44 206/386 |
| 2004/0104138 | A1 * | 6/2004 | Remaks | B65D 19/20 206/386 |
| 2008/0000397 | A1 | 1/2008 | Dickinson et al. | |
| 2008/0257769 | A1 * | 10/2008 | Baechle | B65D 19/20 206/386 |
| 2011/0155601 | A1 | 6/2011 | Hausmann | |

FOREIGN PATENT DOCUMENTS

| | | | |
|---|---|---|---|
| CN | 201457861 | U | 5/2010 |
| CN | 101758971 | A | 6/2010 |
| CN | 201784861 | U | 4/2011 |
| DE | G8805032.7 | U1 | 6/1988 |
| DE | 3709870 | C2 | 10/1988 |
| EP | 1205394 | A1 | 5/2002 |

* cited by examiner

TRANSPORT PACKAGING FOR PACKAGING HAZARDOUS MATERIALS

CROSS-REFERENCE TO RELATED APPLICATIONS

This application is a continuation of International Application No. PCT/EP2012/072750 filed Nov. 15, 2012 which claims the benefit of European Patent Application No. 11189665.0 filed Nov. 18, 2011, the disclosures of which are hereby incorporated by reference in their entirety.

SCOPE OF THE INVENTION

The invention relates to a transport packaging unit and to a method for packaging articles to be transported. In addition, the invention relates to the use of the transport packaging unit. Transport packaging units of this type are used in particular to protect articles to be transported in the form of at least one product during transportation, in particular within the area of the shipping of hazardous materials. These types of hazardous materials can originate, for example, from the area of the chemical industry, the pharmaceutical or diagnostic industry, the medical industry or other branches of industry. Other areas of application are also possible in principle. The transport packaging unit can be used, in particular, for the shipping of hazardous materials, for example hazardous materials of packaging group 3, in particular for transport by land and/or sea.

PRIOR ART

In the daily routine of goods shipment, usually a multitude of products of the same type or of a different type is assembled together so that they can be shipped by rail, road or sea. This is typically effected by using transport pallets, in particular transport pallets with a puncture-resistant base. Transport pallets can be flat structures onto which the products are stacked. Transport pallets can usually be loaded using a lift truck or fork lift truck. The important thing about these types of shipping items which are assembled from the articles to be transported and the transport packaging unit is generally that when the shipping items are produced, sufficient protection during transportation is ensured, for example against falling out and against damage. In the case of hazardous materials according to the regulations of the individual transport operators, specific requirements regarding protection during transport are to be observed, for example fixing the products in the shipping item and/or strapping.

In the case of techniques used up to now to protect items in transport, the articles to be transported, for example at least one product, are as a rule placed manually into a transport carton, usually the size of a pallet, such that a so-called transport pallet packing unit is created. Said packing unit rests, for example, on a so-called Euro pallet or a so-called World pallet, as a rule with a puncture-resistant base, of timber and/or plastics material. Places not completely filled in the packing units can be filled out with empty packing as a load accessory. In addition, protection during transport and/or fixed connection between the transport pallet carton and the carrier pallet must be produced by means of strapping and/or harnessing, for example according to the design type test of the packing for hazardous materials. In addition, one or several edge protecting means can be attached.

Particular requirements, in this case, are applicable to external packaging which includes hazardous materials. These types of hazardous materials, or packing units which contain hazardous materials, are currently packaged as a rule such that first of all an empty transport carton with a closed base, the outside dimensions of which and in particular the area of which corresponds to the surface of a pallet, is placed onto a pallet. The articles to be transported are then introduced from above into the open transport carton, as a rule manually, and are stacked in the transport carton. The transport carton is then closed at the top, secured as a rule with adhesive tape and then fixed on the pallet with packing strips, for example according to the design type test of the packing for hazardous materials.

In practice said conventional method comprises a multitude of disadvantages. One considerable disadvantage is that as a result of filling from above and as a result of the, as a rule, tight stacking inside the transport carton, the packing process is hardly able to be automated. Thus, expensive gripping elements which could carry out stacking in the interior of the transport carton from above would have to be used for automation. This is hardly realizable in practice such that, as a rule, a manual packing process remains the only realizable solution.

A manual packing process of this type, however, comprises a multitude of disadvantages. Thus, the height of the transport cartons placed on the pallets is, as a rule, at least 1 meter. Consequently, to stack the bottommost layers inside the carton, the packing personnel have to bend beyond the carton wall to insert the products and/or the goods in the transport carton. In this case, sometimes considerable loads have to be lifted beyond the carton wall of the transport carton—in a position which is extremely unfavorable ergonomically for the packing personnel—in order to be deposited finally on the base of the transport carton. In this case, sometimes loads of several 100 kg altogether are lifted when loading one single transport carton. In the long term said packing process can result in considerable physical loads for the packing personnel.

In addition, it must be emphasized that the described packing process is extremely time-consuming in spite of using practiced and trained packing personnel. Where there is a high throughput of articles to be transported, the described process can consequently provide a bottleneck in a logistical sequence which can delay the overall time between the delivery of an order and the actual shipping of the ordered products in a considerable manner.

A multitude of apparatuses and methods for packaging articles to be transported are known from the prior art. For example, US 2011/0155601 A1 describes a box produced from fiberboard for the shipment of hazardous materials. Said box includes an outer jacket with a plurality of inserts. The packaging of bottles is described in particular. Said bottles are placed on a bottom tray inside the outer jacket or external packaging and are separated by a separating unit. In addition, a cover part is placed thereon. Consequently, said construction does not solve the above-described problems either as filling still has to be effected from above, which is hardly able to be automated, which is time-consuming and which accordingly for the above-mentioned economic and ergonomic standpoints is not preferred.

EP 1 205 394 A1 describes a pallet for stacking planographic printing plates. In this case, a method for packaging is described where a stack of planographic printing plates is placed above a holding stack which, in turn, is built on a projection of a pallet. Packing material is then wound around said stack in a winding technique such that the packing material takes on the form of a box. Said box is then fastened to the pallet by means of adhesive tape and packing strips are used for securing it. However, a disadvantage of said technique is that a comparatively high expenditure for the packaging has to made, in particular by using the winding technique. Special apparatuses are necessary for this as a rule. In addition, said winding technique which is provided for printed plates is not suitable, as a rule, for the transport of hazardous materials, in particular of packaging group 3, as additional security measures against contained substances leaking would be necessary.

US 2008/0257769 A1 discloses a pallet packaging arrangement in which a transport support and an outer carton are connected to the freight pallet in order to prevent the freight from slipping. In this case, a transport base is folded first of all and an article to be transported is placed thereon. A freight carton is then inverted over the article and the transport base. Straps of the transport base and of the carton are then both fastened to a transport pallet by means of clamps. However, a disadvantage of said packaging technique is that the protection during transport against the freight slipping is developed in a comparatively weak manner. The clamping technique used can result in the straps being torn off in particular where shear forces are high. In addition, suitability for the transport of hazardous materials, for example of packaging group 3, is hardly ensured in this case either as in particular in the region of the bottom edges, tightness of the packaging, in particular against contained substances leaking, can hardly be ensured. Neither is puncture resistance of the base of the pallet, through the boards of the freight pallet and the carton base, ensured in the case of said development. However, such puncture resistance is an important prerequisite, as a rule, for the transport of hazardous materials.

U.S. Pat. No. 4,932,545 describes a container for transporting large or heavy objects. In this case, a freight framework is first of all fixed on a base plate of a pallet. Individual side walls are then mounted around the edge of the base plate. Finally a cover part is mounted on said side walls. In addition, a cardboard box, which serves as an additional outer protective layer, can be slipped onto said container which is produced in this manner. However, a disadvantage of said container is the expensive and complex design. Thus, individual, complicatedly formed, sturdy side walls, which are extremely high-quality as a result of using corresponding profiles and fastening elements and are consequently not suitable for the shipping of mass products, have to be provided. In addition, considerable manual labor is necessary for the assembly of the container from individual parts such that the described container is hardly suitable for the shipping of large quantities. Neither is the suitability for transporting hazardous materials, for example of packaging group 3, ensured, as a rule, as a result of joining the side parts to one another in a form-locking manner.

DE 88 05 32 U1 discloses a warehouse pallet which can be used in particular as an outdoor warehouse pallet. The warehouse pallet comprises a base part which is developed as a tub. In addition, the outdoor warehouse pallet is provided with a cover which covers the tub. As is produced directly from said document, the warehouse pallet is not suitable, as a rule, to serve as a transport packaging unit, in particular for the transport of hazardous materials, for example of packaging group 3. Thus, no protection is provided against the load slipping or being mechanically damaged. Neither is the warehouse pallet guaranteed, as a rule, to be tight against the leaking of substances.

DE 37 09 870 C2 describes a security pallet which has a tub-shaped base plate for receiving loads. In addition, there is provided a cover which is detachably connected to the tub-shaped base plate by means of locking members with a sealing profile connected in between and is fixed in its position on the base tub by means of a circumferential web. Said structure is comparatively expensive as regards technique since a sealing part and a tub have to be provided. Said parts have to be specially matched to one another, which incurs increased expenditure for costs and manufacturing. In addition, the loading of the security pallet described in DE 37 09 870 C2 can also only be automated in practice with difficulty.

OBJECT OF THE INVENTION

It is consequently an object of the present invention to provide a transport packaging unit and a method for packaging articles to be transported which avoid the above-described disadvantages of the prior art at least extensively. In particular, the transport packaging unit is able to be loaded with the articles to be transported in a simple and where possible automatable manner and is also to be usable for hazardous materials. In addition, the above-described ergonomic problems in particular are to be avoided.

DISCLOSURE OF THE INVENTION

Said object is achieved by a transport packaging unit and a method for packaging articles to be transported, with the features of the independent claims. Advantageous further developments of the invention which are realizable individually or in arbitrary combination are shown in the dependent claims.

The transport packaging unit can be used in particular for packaging hazardous materials, in particular hazardous materials of packaging class 3 according to the German Ordinance Concerning the Transport of Dangerous Materials (GefStoffV). Accordingly, the use of the transport packaging unit according to the invention in one or several of the developments described again below for packaging hazardous materials, in particular of packaging group 3, is proposed in a further aspect of the invention. The use can be effected in particular for transport by land and/or sea. It is pointed out that the terms "comprising" and "including" as well as grammatical modifications of said terms are used below in an open manner. Thus, the expressions "A comprises B" or "A includes B" both indicate that A consists exclusively of B and contains no further elements apart from B, or that A contains at least one further element apart from B.

The transport packaging unit comprises a pallet with a base plate, wherein the articles to be transported are receivable on the base plate. A pallet, in this case, is to be understood generally within the framework of the invention as a load carrier and/or transport element which comprises an even bearing surface for placing on an even support surface as well as a loading surface which can be loaded with the articles to be transported, the pallet being transportable together with the articles to be transported. In particular, the pallet can be developed in such a manner that it is transportable by means of a lift truck and/or by means of a fork lift truck. Accordingly, the pallet can comprise, for example, a framework which comprises at least two openings for the engagement of a fork of a fork lift truck and/or lift truck. In particular, the dimensions of the pallet can comprise the dimensions of a Euro pallet or World pallet.

The base plate can be in particular a fixed component of the pallet. For example, the base plate, as described again in more detail below, can be fixed on a framework of the pallet, for example a timber framework, for example by means of nailing down and/or screwing down and/or bonding. The area of the base plate can accordingly correspond to the area of a Euro pallet or a World pallet.

The base plate can preferably be developed so as to be liquid-tight. The base plate can be connected to a framework of the pallet, for example a timber framework, in particular over a large area. For example, the base plate can be connected to the framework by at least 5, preferably at least 10 or even at least 50 fastening elements, for example screws or nails which are distributed over a bearing surface of the base plate on the framework. The connection is preferably effected in such a manner that the liquid-tightness of the base plate is not much influenced. This can be achieved, for example, as a result of inserting an additional sealing element, for example a sealing washer of plastics material, between the head of the screw-shaped or nail-shaped fastening element and the base plate when inserting screw-shaped or nail-shaped fastening elements.

In general, a base plate is to be understood as a plate-shaped element, preferably a plate-shaped element which is developed in a completely even manner. In particular, the base plate can define a plane, inside which the base plate extends. Perpendicular to said plane the base plate preferably comprises a thickness which is smaller by at least a factor of 10, preferably by at least a factor of 100, than a lateral dimension of the base plate in the named extension plane, for example than an edge length in one or several dimensions and/or than a diameter or equivalent diameter. For example, the base plate can comprise a thickness of between 1 mm and 10 mm, preferably a thickness of between 2 mm and 5 mm and in a particularly preferred manner a thickness of 3 mm.

For example, the base plate can be developed so as to be puncture-resistant. Puncture resistance, also called puncture strength, is to be understood within the framework of the present invention as a characteristic of the base plate, according to which the base plate is not able to be punctured by sharp objects in the case of usual loads occurring during transport. For example, the base plate, in this regard, can satisfy corresponding regulations of the European Convention concerning the International Carriage of Dangerous Goods by Road, which is also called the ADR. In particular, with regard to puncture resistance, the base plate can satisfy the regulations in Part 6 of the ADR (Building and testing regulations for packaging items, large packing means (IBC), large packaging items and tanks). In particular, the base plate can generally satisfy one or several of the regulations for large packaging items produced from paperboard (UN 50 G), and in particular according to Sections 6.6.4.4 to 6.6.4.4.8 of the ADR. Thus, the base plate can satisfy in particular the regulations with regard to puncture resistance which are described in Section 6.6.4.4.2 ADR. For example, the base plate can accordingly comprise a puncture resistance of at least 15 J, measured according to ISO standard 3036:1975. Other developments, however, are also possible in principle. The base plate can be produced, in particular, from a timber material, a plastics material, a composite material or a fiber material. A laminar construction with more than one layer is also possible.

It is particularly preferred when the base plate is developed as a hard particle board. The hard particle board can include, in particular, a smooth side and a rough side, for example a corrugated side. The smooth side, for example, can be facing a framework, in particular a timber framework, and/or a timber plate of the pallet such that the rough side is able to serve, for example, as a non-slip side of the pallet. The hard particle board can comprise a thickness, for example, of between 0.5 mm and 20 mm, in particular a thickness of between 1 mm and 10 mm, in a particularly preferred manner a thickness of between 2 mm and 5 mm and in particular a thickness of 3 mm. The hard particle board can be fixed, for example, with at least 3, preferably with at least 5 and in a particularly preferred manner with 9 or more fastening elements on a framework, in a preferred manner a timber framework, for example a timber plate, for example with nails. The base plate can be developed, for example, in a rectangular manner, for example with the area of a Euro pallet or the area of a World pallet. For example, the base plate can comprise an area of a rectangle with an edge length of 800 mm×1200 mm. However, other dimensions are also possible in principle.

The base plate, as stated above, can be placed, for example, on a framework of the pallet, for example a timber framework. As described above, said framework can comprise, for example, one or more openings for the engagement of a fork of a fork lift truck and/or lift truck. The framework can be dimensioned, for example, in such a manner that the framework with the base plate placed thereon comprises substantially a height of a Euro pallet or a World pallet, for example with a deviation of no more than 20%, in particular of no more than 10% and in a particularly preferred manner of no more than 5% or even no more than 2% in one, two or three dimensions.

In addition, the transport packaging unit includes a transport box which is open toward the base plate, wherein the transport box rests on the base plate and together with the base plate forms an interior of the transport packaging unit which receives the articles to be transported.

A transport box, in this case, is to be understood within the framework of the present invention as an element which, at least in a closed state, together with the base plate envelops the articles to be transported. The transport box can be developed, in particular so as to be rigid such that said transport box, for example in a closed state, protects the articles to be transported against mechanical influences and/or against overturning. Accordingly, the transport box can be developed, for example, mechanically in such a manner that said transport box is not pushed in or damaged at least manually under usual handling conditions.

The transport box is open toward the base plate. Accordingly, the transport box comprises at least one opening, preferably precisely one opening, toward the base plate. Said opening is preferably developed without closure elements such that even during transport the transport box is open toward the base plate. The base plate and the inside walls of the transport box consequently define the interior that receives the articles to be transported. For example, said interior can be developed in the manner of a cuboid.

The opening of the transport box toward the base plate can be developed in particular in a rectangular manner. As stated in more detail below, the opening is preferably adapted to the outer dimensions of the base plate or is simply slightly (considering the thickness of the wall of the transport box) smaller than the outer dimension of the base plate, preferably a maximum of the same size as the outer dimension of the base plate.

The transport box can be placed onto the base plate for example in the form of a sleeve and/or a collar, wherein an edge of the sleeve pointing to the base plate rests preferably directly on the base plate and without further elements being connected in between. The sleeve can comprise, for example, a rectangular cross section. On an end pointing away from the base plate, the sleeve can comprise, for example, a closable opening, for example one, two, three, four or more folding flaps. The sleeve can be placed onto the base plate in the open or closed state. As is described in more detail below, said placing can be effected preferably at a time when the articles to be transported have already been placed completely onto the base plate. The transport box can also be developed as a cover, for example as a cuboid cover, with a base part which is open toward the base plate. Said cover can be inverted over the articles to be transported.

As stated above, the transport box can comprise, in particular, a closable opening on a side opposite the base plate, in particular an opening which is closable by means of one, two, three, four or more folding flaps. For example, the transport box can be placed onto the base plate in the form of a sleeve, the transport box surrounding the articles to be transported received on the base plate at the sides. The closable opening on the side opposite the base plate can be closed then or prior to this, for example by folding in the folding flaps as well as, where applicable, by additional bonding, for example by means of one or more adhesive strips.

The transport box is fixed to the base plate, for example on the base plate, by means of at least one fastening element. It is particularly preferred when the transport box is pressed onto the base plate, for example with an edge of the transport box which points to the base plate. Said edge can comprise, for example, a rectangle. For example, in this case this can be a simple, circumferential edge, the thickness of which corresponds at least approximately to a thickness of the side walls of the transport box, preferably without flaps of the transport box standing out to the side from said edge. The fastening element can include, for example, at least one packing strip. The optional pressing of the transport box onto the base plate can be effected, for example, in such a manner that a force is exerted onto the transport box and/or the pallet at least partially perpendicular, preferably exclusively perpendicular, to the base plate. A packing strip within the framework of the present invention is to be understood in general as an element which is developed at least in part in a strip-shaped manner and is able to be wrapped around at least part of the transport box and around at least part of the pallet in order to press the transport box onto the base plate. Said packing strip can engage in a framework of the pallet, for example on a bottom surface of the transport packaging unit and can surround the transport box on a top side of the transport packaging unit. The packing strip can be closed, in particular. For example, two, three, four or more packing strips can be provided. The packing strip can be developed, for example, in a ring-shaped manner and surround the transport packaging unit in a ring-shaped manner, it being possible as an option for the packing strip to engage in the pallet in one or several places. The packing strip can be produced, for example, completely or in part from a plastics material and/or completely or in part from a metallic material. For example, the packing strip can be developed as a strip with a width of between 5 mm and 50 mm and in a particularly preferred manner with a width of between 10 mm and 40 mm. The packing strip can comprise, for example, a thickness of between 0.5 mm and 4 mm, for example a thickness of 1 mm. The packing strip, as preferably also all the other packing aids used, can correspond in particular to a design type test, in particular according to an approval of the Federal Institute for Materials Testing in Germany (BAM approval). The packing strip can be developed, in particular, as a closed, ring-shaped strip. In particular, the packing strip can include at least one strap, that is a closed strip, the ends of which are connected together in order to form a closed ring. In particular, the ends can be connected together in a positively bonded manner, for example by means of welding and/or bonding.

It is particularly preferred when the packing strip encompasses the transport packaging unit simply in one direction of winding, that is simply with one, two, three, four or more windings about a rotational axis. Said rotational axis is preferably developed so as to be parallel to a longer side of a preferably rectangular area of the base plate. Harnessing of this type by means of one, two, three, four or more packing strips can also be called cross harnessing. Simple cross harnessing of this type without additional longitudinal harnessing is simple to realize automatically as it is not necessary to rotate the transport packaging unit in a machine carrying out the harnessing.

As an alternative to or in addition to using at least one packing strip as a fastening element for fastening the transport box on the base plate, other fastening elements are also conceivable, for example one or several clamps and/or one or several adhesive tapes, in particular insofar as this corresponds to the design type test (BAM approval). Said fastening elements, in this case, can be present separately from the transport box and separately from the base plate as independent elements or can also be connected to the transport box and/or the base plate.

The transport box, as stated above, can rest in particular directly on the base plate. This means that preferably no intermediate element is inserted between the transport box and the base plate. In particular, a sealing element is not necessary in practice.

The base plate and the transport box can close off in particular the interior in a tight manner. Said tight closure can be ensured in particular in conjunction with the above-described at least one fastening element, for example with the at least one packing strip.

The base plate can preferably be developed as an even base plate, as stated above. In addition, the base plate can preferably be developed as an opening-free base plate, that is as a base plate which does not comprise at least any macroscopic openings with a diameter or equivalent diameter of more than 1 mm, preferably of more than 500 μm and in a particularly preferred manner of more than 100 μm. Accordingly, the base plate can preferably be developed in a tight manner, for example for liquids, such that, for example, direct leaking of liquids through the base plate can be prevented. In addition, the base plate can preferably be realized so as to be puncture-resistant, which serves for protecting the articles to be transported and/or the products in a mechanical manner.

As stated above, the base plate can be, in particular, a completely even base plate. Accordingly, the base plate can comprise in particular the form of a plate without an elevated edge and/or without protruding elements. In particular, the base plate can comprise a rectangular cross section and/or a rectangular area.

The base plate can be developed in particular completely or in part as a hard particle board. As an alternative to this or in addition to it, however, other materials can also be used in principle, such as for example plastics materials. Hard particle boards, for example hard particle boards provided with pressed materials and as an option with additives such as, for example, binders, for example standard hard particle boards, have, however, proven to be particularly suitable in practice, in particular for transporting hazardous materials.

The pallet can include in particular a timber pallet. The base plate can be fixed on said timber pallet, for example by means of nails and/or screws. Thus, the timber pallet can include, for example, a timber framework, for example as described above, which can comprise in particular one or more openings for the possibility of the engagement of a fork of a fork lift truck and/or of a lift truck. The base plate can be placed onto said timber framework of the timber pallet and fixed on the timber pallet, for example by means of nails and/or screws and/or by means of bonding. The base plate and the timber pallet can then together form the pallet and/or be a component of the pallet.

Further possible developments relate to the development of the transport box. The transport box, as stated above, can be developed in particular as a cover. In particular, the transport box can be developed completely or in part as a cuboid cover with an open base.

The transport box can be developed in particular as a so-called part folding box. A part folding box, in this case, is to be understood as a box which can be produced as a result of a folding operation. During the folding operation a blank is used, for example produced from a cardboard material, which comprises one, two, three, four or more folding flaps on one side. The designation part folding box results from the fact that the blank preferably does not comprise any of these types of folding flaps on the side lying opposite the folding flaps, but is simply open and for example comprises a simple, circumferential edge which can be placed onto the base plate. During the folding operation the part folding box can be folded up initially in such a manner that a sleeve is created, for example a sleeve with a rectangular area. In the case of said first step, the folding flaps can initially remain parallel to the side walls of said sleeve. The sleeve, formed in this manner, can then be placed onto the base plate, as is described in more detail below, the edge of the sleeve lying opposite the folding flaps being placed onto the base plate. For example, in the case of said operation, the sleeve formed from the part folding box can be inverted over the articles to be transported on the base plate such that the sleeve surrounds the articles to be transported in directions in space parallel to the plane of extension of the base plate. The at least one flap of the part folding box can then be folded over, for example by said flap being folded into a direction in space parallel to the extension of the base plate. The transport box can be closed on a side lying opposite the base plate in this manner.

The transport box can close off in particular flush with the pallet at the sides. The transport box can consequently be placed onto the pallet, in particular the base plate, in particular in a form-locking manner. Thus, the transport box, for example in a state placed onto the base plate, can comprise an area which is identical to the area of the base plate. In other words, the transport box can be developed in such a manner that it does not project beyond the base plate preferably in any direction in space parallel to the area of the base plate and/or that the base plate does not project beyond the transport box in any direction in space parallel to the extension of the base plate. In this context, tolerances with regard to the projections of preferably less than 10 mm, in particular of less than 5 mm, can be acceptable. However, it is particularly preferred when neither the transport box nor the pallet comprise a projection at the side since, for example according to the German Law on Load Safety, as a rule gaps which are greater than 3 cm must be filled out such that in the case of projecting embodiments as a rule additional measures have to be carried out for the specialist transport thereof.

The pallet can be in particular a standard pallet or can comprise outer dimensions which correspond to a standard pallet. Thus, the pallet can be developed, for example, as a Euro pallet or as a World pallet. As an alternative to this, the pallet can also be developed in such a manner that the pallet including the base plate comprises the dimensions of a Euro pallet or a World pallet. Deviations of the pallet of preferably not more than 20% in one, several or all directions in space, preferably of not more than 10% and in a particularly preferred manner of not more than 5% from the dimensions of a Euro pallet and/or a World pallet are possible. As an alternative to this, other dimensioning is also possible.

The pallet can be produced in particular, as stated above, completely or in part from timber.

The transport box can preferably be produced from a cardboard material, in particular from corrugated board. Thus, the transport box can be produced preferably completely or in part from two-layered corrugated board. As an alternative to this or in addition to it, however, other materials can also be used. Particularly preferred, however, is a transport box which can be produced from a folding blank of a cardboard material, for example of corrugated board.

In addition, at least one spacer can be received in the interior of the transport box. Said spacer can be received in particular between the articles to be transported and at least one inside wall of the transport box. Said at least one spacer can be received, for example, in one or two or three directions in space between the articles to be transported and the inside wall. The at least one spacer can be developed for example in a plate-shaped manner, for example with a thickness of between 5 mm and 100 mm, in particular with a thickness of between 10 mm and 70 mm, preferably with a thickness of between 20 mm and 60 mm and in a particularly preferred manner with a thickness of 40 mm. The at least one spacer can be produced in particular in turn completely or in part from at least one cardboard material, in particular from corrugated board and in a particularly preferred manner from a folded cardboard material. Thus, the at least one spacer can be produced, for example, once again from a single-layered, double-layered or multiple-layered corrugated board material. In addition, one or several blanks, which can be folded and as an option bonded, can be used to produce the spacer.

The transport box can comprise in particular a cuboid form. In all, the transport packaging unit as a whole can also comprise a substantially cuboid form, wherein deviations from the cuboid form in particular in the region of the pallet, for example as a result of one, two or more openings for the engagement of a fork of a fork lift truck and/or a lift truck, ought to still be included by the expression "a substantially cuboid form".

In a further aspect of the present invention, a method for packaging articles to be transported, in particular hazardous materials and in a particularly preferred manner hazardous materials from the packaging group 3, is proposed. The method can be carried out in particular by using the transport packaging unit according to one or several of the above-described developments as well as, where applicable, by using one or several of the exemplary embodiments described in more detail below. Regarding this, reference can be made to the description of the packaging of the transport packaging unit for optional details of the method. In principle, however, other transport packaging units can also be used within the framework of the present method.

The method comprises the following steps. The following steps are preferably, but not necessarily, carried out in the sequence shown. In addition, one, several or all of the method steps can also be carried out in a repeated manner individually or in groups. In addition, individual, several, or all of the method steps can be carried out one after another overlapping in time or also simultaneously. The method can consist exclusively of the named steps. In addition, however, the method can include one or several further method steps.

In a first method step (method step a)) at least one pallet is prepared, wherein the pallet comprises a base plate. Reference can be made to the above description with reference to possible developments of the pallet and of the base plate.

In a further method step (method step b)) the articles to be transported are placed onto the base plate. In this case, the articles to be transported can be received for example in one or several primary packagings such that the articles to be transported can be formed, for example, by one or several packing items and/or can include one or several packing items. For example, the packing items can include cuboid cardboard boxes, each cardboard box being able to include, for example, one or several products. For example, one or several bottles and/or receptacles for solid, gaseous or liquid media can be received in the cardboard boxes, where applicable with the addition of additional packing means such as, for example, padding.

The placing of the articles to be transported onto the base plate can be effected in particular in a manual manner. Automatic placing, however, is also conceivable in principle. For example, the articles to be transported can be placed onto the base plate in one or several layers. In this case, the articles to be transported can be stacked, for example, in such a manner that, as a result of the multiple-layered stacking, the articles to be transported form a quantity of articles to be transported which are stacked in the manner of a cuboid on the base plate, the articles to be transported stacked in a cuboid manner being preferably aligned parallel to the edges of the base plate.

The articles to be transported can be placed directly onto the base plate. As an alternative to this, at least one intermediate element, for example at least one piece of packing paper and/or at least one plastic film can also be inserted between the base plate and the articles to be transported.

In a further method step (method step c)) a transport box which is open toward the base plate is inverted over the articles to be transported. Said transport box can be developed in an open or closed manner at a top end remote from the base plate during the inverting. In an open state, the transport box forms, for example, a sleeve, for example a sleeve with a rectangular area which is inverted over the articles to be transported. In a closed state the transport box can form, for example, a cuboid cover and be closed on a top side remote from the base plate, for example by folding flaps on said side of the transport box already being closed in this step. However, a development where in method step c) the transport box is inverted as a sleeve over the articles to be transported is preferred.

In method step c) the transport box is placed onto the base plate. Said placing can be effected, for example, as a result of an edge of the transport box being placed preferably directly on the base plate. The placing is effected in such a manner that the transport box forms together with the base plate an interior of the transport packaging unit which receives the articles to be transported. As stated above, this can be, for example, a cuboid interior. The forming of the interior by the base plate and the transport box is independent of whether the transport box rests directly on the base plate or whether at least one intermediate element, for example at least one intermediate element resting on the base plate, for example a film and/or a piece of paper, is situated as an option between the transport box and the base plate and/or between the interior and the base plate. The intermediate element can preferably comprise a thickness of not more than 10 mm, in particular of not more than 5 mm and in a particularly preferred manner of not more than 1 mm or even of not more than 500 μm. Both options, that is the placing of the transport box directly onto the base plate or the optional interposing of at least one intermediate element between the base plate and the transport box, are to be included by the method step c) as in both cases the base plate and the transport box form or surround the interior of the transport packaging unit.

The method additionally includes at least one fixing step (method step d)). Said fixing step can be effected, for example, after the method step c) is carried out. In the fixing step the transport box can be fixed on the base plate by means of at least one fastening element, for example by means of one, two, three, four or more fastening elements. In particular, the transport box can be pressed onto the base plate in said fixing step. As stated above, the at least one fastening element can include, for example, at least one packing strip, preferably two, three, four or more packing strips. As described above, cross harnessing can be effected in particular, preferably exclusively cross harnessing.

In the method step c) the transport box can be placed onto the base plate preferably so as to be flush at the sides. In this connection, the above-mentioned tolerances with regard to being flush are acceptable in one or two directions in space.

The method can additionally include at least one method step e). Said method step which is carried out preferably prior to the fixing step d), but preferably after the method step c), is a closure step. The transport box preferably comprises, as described above, a closable opening on a side opposite the base plate, that is remote from it. For example, as described above, the transport box can be developed as a part folding box, after folding the part folding box to form a sleeve, an open bottom edge of the part folding box being placed onto the base plate and being preferably inverted over the articles to be transported. On the side opposite the positioned edge, that is remote from it, for example the top side of the transport box, the at least one closable opening can then be closed, for example by folding over the one, two, three, four or more folding flaps. The closable openings can be closed in the closure step, in particular by folding over the optional folding flaps. Another type of closure is also conceivable. The closable opening can be additionally secured after closing, for example by one or several adhesive strips. Said securing is preferably effected by means of adhesive tape in a direction perpendicular to cross harnessing.

In addition, the method can include at least one method step in which at least one spacer is inserted into the interior between the articles to be transported and at least one inside wall of the transport box. Said step can be effected in particular prior to carrying out the above-described optional closure step e). Thus, for example, the transport box can be inverted initially in the form of a sleeve over the articles to be transported which are placed directly or indirectly on the base plate. The at least one spacer can then be inserted between the articles to be transported and the inside wall of the transport box. The above-described closure step d) can then be carried out.

The above description can be referred to with reference to the possible developments of the at least one spacer which is preferably inserted in one, two or three directions in space between the articles to be transported and the inside wall.

The articles to be transported can be placed onto the base plate in particular in such a manner that in at least one direction in space there is a spacing of between 10 mm and 200 mm to the inside wall, in particular a spacing of between 20 and 100 mm and in a particularly preferred manner a spacing of 40 mm. Said spacing can correspond to the preferred thickness of one, two or several spacers. Said spacing can be ensured, for example, in such a manner that the articles to be transported are stacked directly or indirectly on the base plate in the form of a cuboid of articles to be transported. Said cuboid of articles to be transported can comprise, for example, a rectangular area, the sides of the rectangle preferably being developed substantially parallel to the sides of the base plate. The term "substantially parallel", in this case, means that angular deviations of less than 20°, preferably of less than 10°, are tolerable. The rectangle of the area of the cuboid of articles to be transported is preferably developed so as to be smaller than the rectangle of the area of the base plate. In this case, the rectangle of the area of the cuboid of articles to be transported can be arranged with its sides at a spacing in such a manner from the outside edges of the rectangle of the base plate that the above-described spacings between the articles to be transported and the inside wall of the transport box are ensured.

In a further aspect of the present invention the use of a transport packaging unit is proposed according to one or several of the developments according to the invention which have been described above or are described in more detail below. In this case, the use of the transport packaging unit for packaging hazardous materials, in particular hazardous materials of packaging group 3, is provided. In particular, the use can be effected for transport by land (for example by means of trucks) and/or for transport by sea. Other uses, however, are also conceivable in principle. The above-described transport packaging unit, the method and the use comprise numerous advantages compared to known apparatuses and methods. A hazardous materials packaging unit which satisfies all the legal regulations for a hazardous material packaging unit, for example with regard to stability and/or protection against damage, can be realized in particular in the manner described. The satisfying of the named regulations, in this case, is possible in a simple and cost-efficient manner without any need for expensive, complex components which have to be matched to one another, such as for example base tubs or similar elements.

At the same time a user-friendly and ergonomic packaging unit can be realized, in particular a hazardous materials packaging unit. The above-described, ergonomically unfavorable loading of a box from above with a multitude of heavy packing items is now no longer necessary in practice, as the articles to be transported have to be placed onto the base plate for example directly or by interposing just one or several foil elements. Said placing-on can be effected without the hazardous materials having to be lifted over an edge, for example an elevated edge of a tub and/or an elevated wall of a box which is open upward. The loading of the base plate can be effected in practice at ground level, it simply being necessary, at least when creating a first layer of packing items, to overcome the height of the pallet including the base plate.

At the same time a high degree of automation can be achieved as the loading of the base plate, preferably without overcoming an elevated edge or without the need for inserting the packing items into the interior of an upwardly open transport box, can be realized in a simple manner, for example by means of grippers and/or fork lift trucks.

Whilst in the case of a classic hazardous materials packaging unit consequently in pallet format, as a rule the packing items have to be lifted from above into an upwardly open cardboard box which is then closed and can be harnessed to a pallet, the packing concept according to the invention makes clearly simpler and more protective loading possible. For example, the pallet with the base plate, preferably the closed base plate, onto which the packing items can be correspondingly stacked, can be provided first of all. A downwardly open cardboard box can then be inverted onto said loaded pallet, possible cavities being able to be filled out and closed then by means of one or several spacers and/or other types of packing aids. Said cardboard box can then be closed and harnessed to the pallet. In this case, the cardboard box can preferably be pressed onto the closed base of the pallet. It can be shown that all the requirements with reference to the stability and tightness of the transport packaging unit can be satisfied in this manner.

Additional sealing elements, in particular additional sealing elements between the transport box, for example the part folding box, and the base plate in particular, can be dispensed with within the framework of the proposed method and within the framework of the proposed transport packaging unit. The additional sealing parts and parts that are specially matched to one another can be dispensed with as a result of the preferred simple pressing of the transport box with the pallet according to the invention, for example by means of harnessing, a planar base plate preferably being used, as well as the preferred materials used. Consequently, it is possible to realize a cost-efficient method which is also suitable for use in shipping large quantities of articles to be transported. In this case, on the one hand tight, that is versatile mechanical protection of the articles to be transported against damage can be realized. In particular, puncture resistance of the transport packaging unit can be ensured such that the articles to be transported can be protected well against outside influences, in particular by an interior which is closed on all sides. On the other hand, the protection can also be developed as an option in such a manner that security against leaking is provided such that the transport packaging unit as an option is able to suppress leaking contents at least in part.

All in all, according to the invention preferably hazardous materials can be transported, for example hazardous materials of packaging group 3. The transport box, as described above, can be placed onto the base plate in a simple manner in particular in the form of a sleeve and/or in the form of a pallet collar. In this case, said pallet collar of the transport box can be inverted over the articles to be transported which have already been placed onto the base plate such that the pallet collar surrounds the articles to be transported at least in directions in space parallel to the plane of the base plate. Once the pallet collar has been closed, for example by folding the folding flaps, as well as, where applicable, bonding by means of at least one adhesive tape, harnessing can be effected onto the pallet, for example quadruple harnessing. With said harnessing, the transport packaging unit, which then forms a packing unit, corresponds to the approval defaults for example of the Federal Institute for Materials Testing BAM in the Federal Republic of Germany.

In summary, the following embodiments within the framework of the present invention are particularly preferred:

Embodiment 1

Transport packaging unit for packaging articles to be transported, in particular hazardous materials, wherein the transport packaging unit comprises the following:

- a pallet with a base plate, wherein the articles to be transported are receivable on the base plate;
- a transport box which is open toward the base plate, wherein the transport box rests on the base plate and together with the base plate forms an interior of the transport packaging unit which receives the articles to be transported, wherein the transport box is fixed on the base plate, in particular is pressed onto the base plate, by means of at least one fastening element.

Embodiment 2

Transport packaging unit according to the preceding embodiment, wherein the transport box has a closable opening on a side opposite the base plate, in particular an opening which is closable by means of folding flaps.

Embodiment 3

Transport packaging unit according to one of the preceding embodiments, wherein the fastening element includes at least one packing strip.

Embodiment 4

Transport packaging unit according to one of the preceding embodiments, wherein the transport box rests directly on the base plate.

Embodiment 5

Transport packaging unit according to one of the preceding embodiments, wherein the base plate and the transport box close off the interior in a tight manner, in particular tight against mechanical influences from the outside and/or tight against damage, as an option tight against the leaking of contained substances.

Embodiment 6

Transport packaging unit according to one of the preceding embodiments, wherein the base plate is an opening-free base plate.

Embodiment 7

Transport packaging unit according to one of the preceding embodiments, wherein the base plate is an even base plate.

Embodiment 8

Transport packaging unit according to one of the preceding embodiments, wherein the base plate is a hard particle board.

Embodiment 9

Transport packaging unit according to one of the preceding embodiments, wherein the pallet includes a timber pallet, wherein the base plate is preferably fixed on the timber pallet, in particular by nails and/or screws and/or bonding.

Embodiment 10

Transport packaging unit according to one of the preceding embodiments, wherein the transport box is developed as a cuboid cover with an open base.

Embodiment 11

Transport packaging unit according to one of the preceding embodiments, wherein the transport box is developed as a part folding box.

Embodiment 12

Transport packaging unit according to one of the preceding embodiments, wherein the transport box closes off flush with the pallet at the sides.

Embodiment 13

Transport packaging unit according to one of the preceding embodiments, wherein the pallet is a Euro pallet or a World pallet or including the base plate comprises the dimensions of a Euro pallet or a World pallet.

Embodiment 14

Transport packaging unit according to one of the preceding embodiments, wherein the pallet is produced completely or in part from timber.

Embodiment 15

Transport packaging unit according to one of the preceding embodiments, wherein the transport box is produced from a cardboard material, in particular from corrugated board.

Embodiment 16

Transport packaging unit according to one of the preceding embodiments, wherein at least one spacer is received in the interior between the articles to be transported and at least one inside wall of the transport box.

Embodiment 17

Transport packaging unit according to the preceding embodiment, wherein the spacer is produced completely or in part from a cardboard material, in particular from a corrugated board, in particular from a folded cardboard material.

Embodiment 18

Transport packaging unit according to one of the preceding embodiments, wherein the transport box comprises a cuboid form.

Embodiment 19

Transport packaging unit according to one of the preceding embodiments, wherein the transport packaging unit substantially comprises a cuboid form.

Embodiment 20

Method for packaging articles to be transported, in particular hazardous materials, wherein the method comprises the following steps:

a) at least one pallet is prepared, wherein the pallet comprises a base plate;

b) the articles to be transported are placed onto the base plate;

c) a transport box which is open toward the base plate is inverted over the articles to be transported, wherein the transport box is placed on the base plate in such a manner that the transport box together with the base plate forms an interior of the transport packaging unit which receives the articles to be transported; and d) at least one fixing step, wherein in the fixing step the transport box is fixed on the base plate by means of at least one fastening element, in particular is pressed onto the base plate.

Embodiment 21

Method according to the preceding embodiment, wherein the fixing is effected by means of at least one packing strip, in particular by means of at least two packing strips, and in a particularly preferred manner by means of at least four packing strips.

Embodiment 22

Method according to the preceding embodiment, wherein the fixing includes exclusively cross harnessing.

Embodiment 23

Method according to one of the preceding embodiments which relate to a method, wherein in method step c) the transport box is placed onto the base plate so as to be flush at the sides.

Embodiment 24

Method according to one of the preceding embodiments which relate to a method, additionally including the following method step:

e) a closure step, wherein the transport box has a closable opening on a side opposite the base plate, in particular an opening which is closable by means of folding flaps, wherein the closable opening is closed in the closure step, in particular by folding over the folding flaps.

Embodiment 25

Method according to the preceding embodiment, wherein, once closed, the closable opening is secured additionally by adhesive tape.

Embodiment 26

Method according to one of the preceding embodiments which relate to a method, wherein at least one spacer is inserted into the interior between the articles to be transported and at least one inside wall of the transport box, in particular prior to carrying out the method step e).

Embodiment 27

Method according to the preceding embodiment, wherein in method step b) the articles to be transported are placed onto the base plate in such a manner that in at least one direction in space there is a spacing of between 10 mm and 200 mm to the inside wall, in particular a spacing of between 20 mm and 100 mm and in a particularly preferred manner a spacing of 40 mm.

Embodiment 28

Method according to one of the preceding embodiments which relate to a method, wherein in the case of the method a transport packaging unit according to one of the preceding embodiments which relate to a transport packaging unit is used and/or wherein a transport packaging unit according to one of the preceding embodiments which relate to a transport packaging unit is formed.

Embodiment 29

Use of a transport packaging unit according to one of the preceding embodiments which relate to a transport packaging unit for packaging hazardous materials, in particular of packaging group 3, in particular for transport by land and/or sea, for example by road and/or rail and/or sea and/or by means of river boat.

BRIEF DESCRIPTION OF THE FIGURES

Further details and features of the invention are produced from the following description of preferred exemplary embodiments, in particular in connection with the subclaims. In this connection, the respective features can be realized individually on their own or in groups in combination together. The invention is not limited to the exemplary embodiments. The exemplary embodiments are shown in a schematic manner in the figures. The same reference numerals in the individual figures, in this case, designate the same elements or elements with the same function or elements that correspond to one another with regard to their functions.

The figures in which, in detail.

EXEMPLARY EMBODIMENTS

Figure 2:
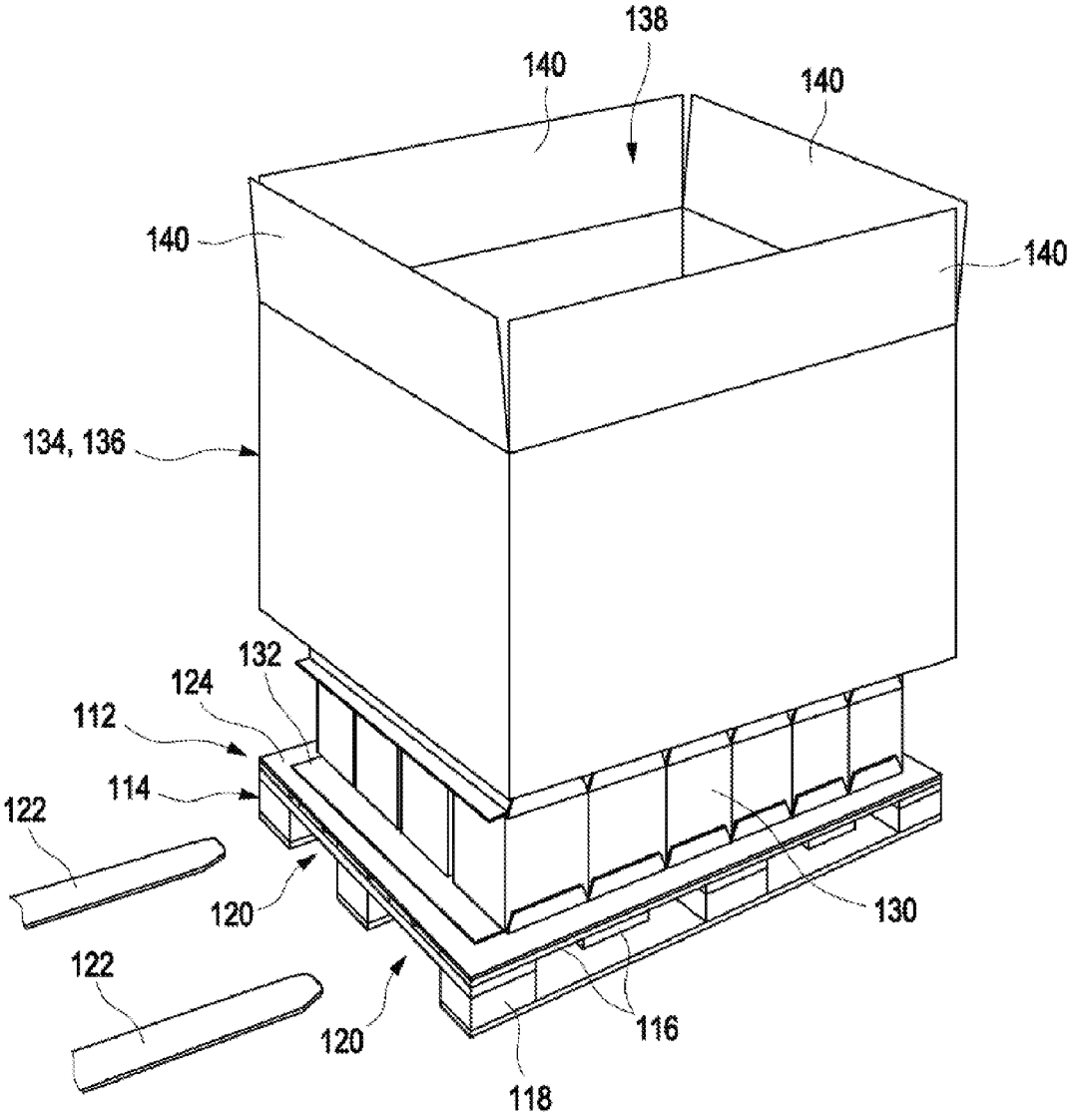
FIG. 2 shows an exemplary embodiment of a method according to the invention for packaging articles to be transported.
Figure 3:
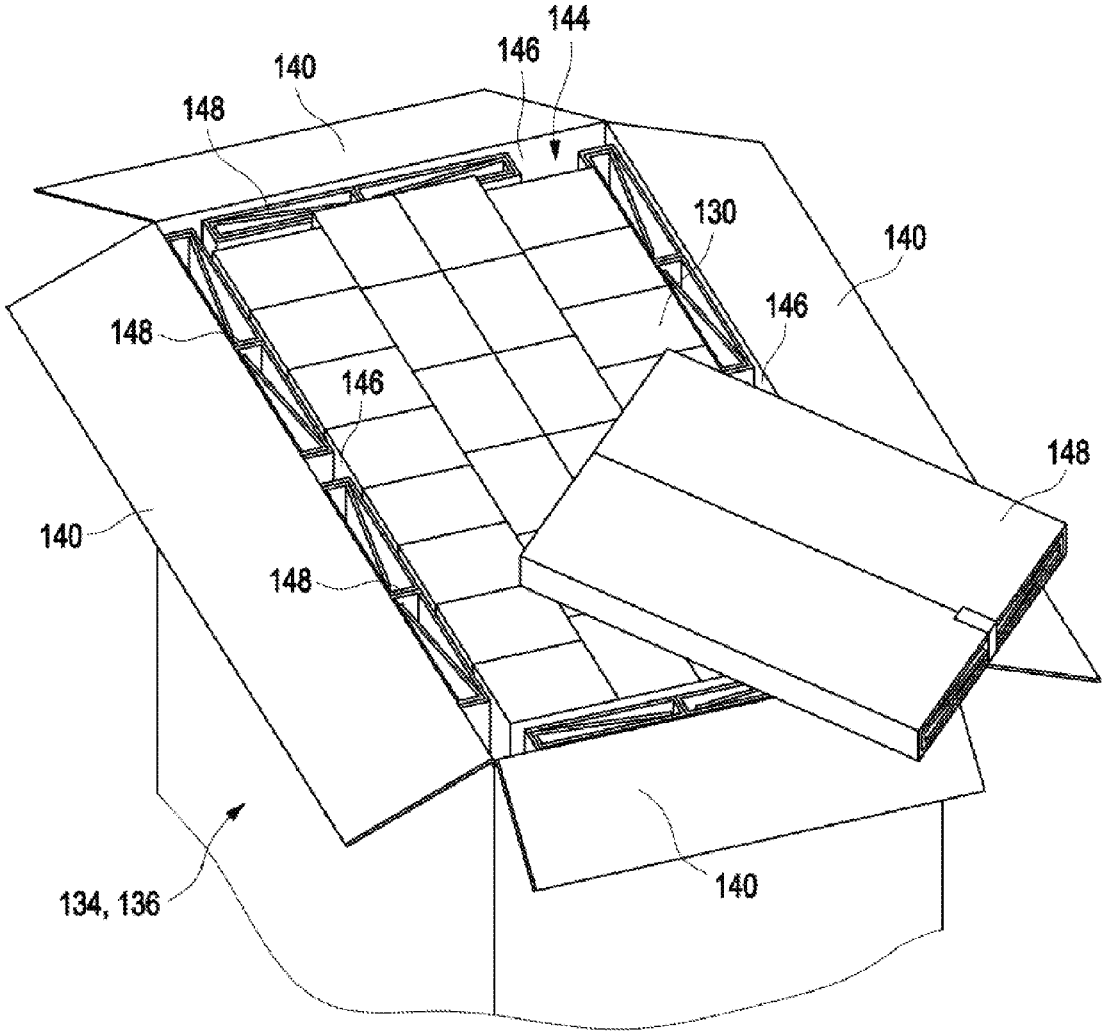
FIG. 3 shows an exemplary embodiment of inserting spacers into a transport box within the framework of a method proposed according to the invention.
Figure 4:
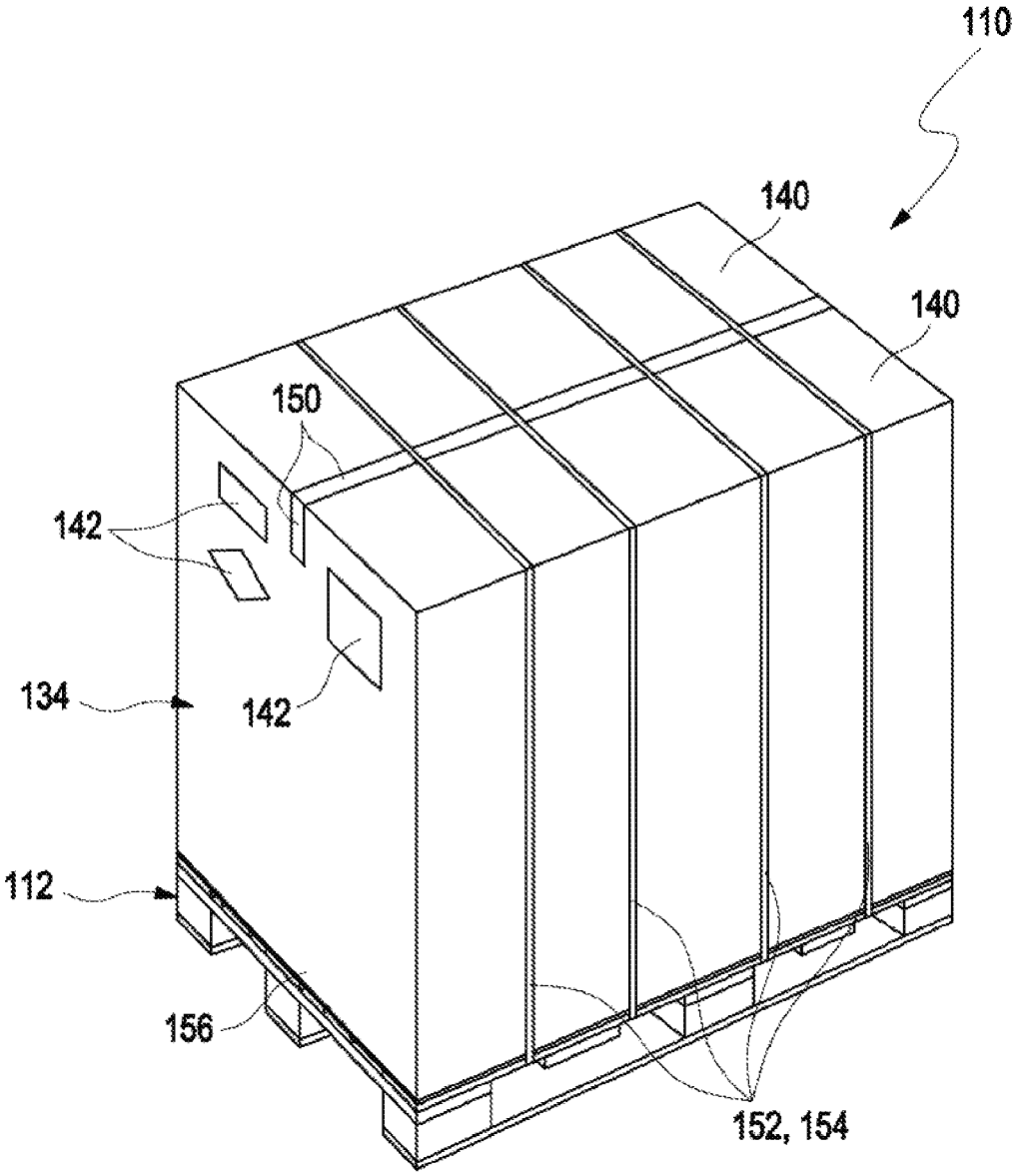
FIG. 4 shows an exemplary embodiment of a pre-packed transport packaging unit according to the present invention.

FIGS. 1-4 show an exemplary embodiment of a method according to the invention for packaging articles to be transported in a possible sequence of method steps. At the same time, FIG. 4 shows an exemplary embodiment of a transport packaging unit 110 which is used with said method and/or is created according to the invention. Reference is made below to all of said FIGS. 1-4 together.

Figure 1:
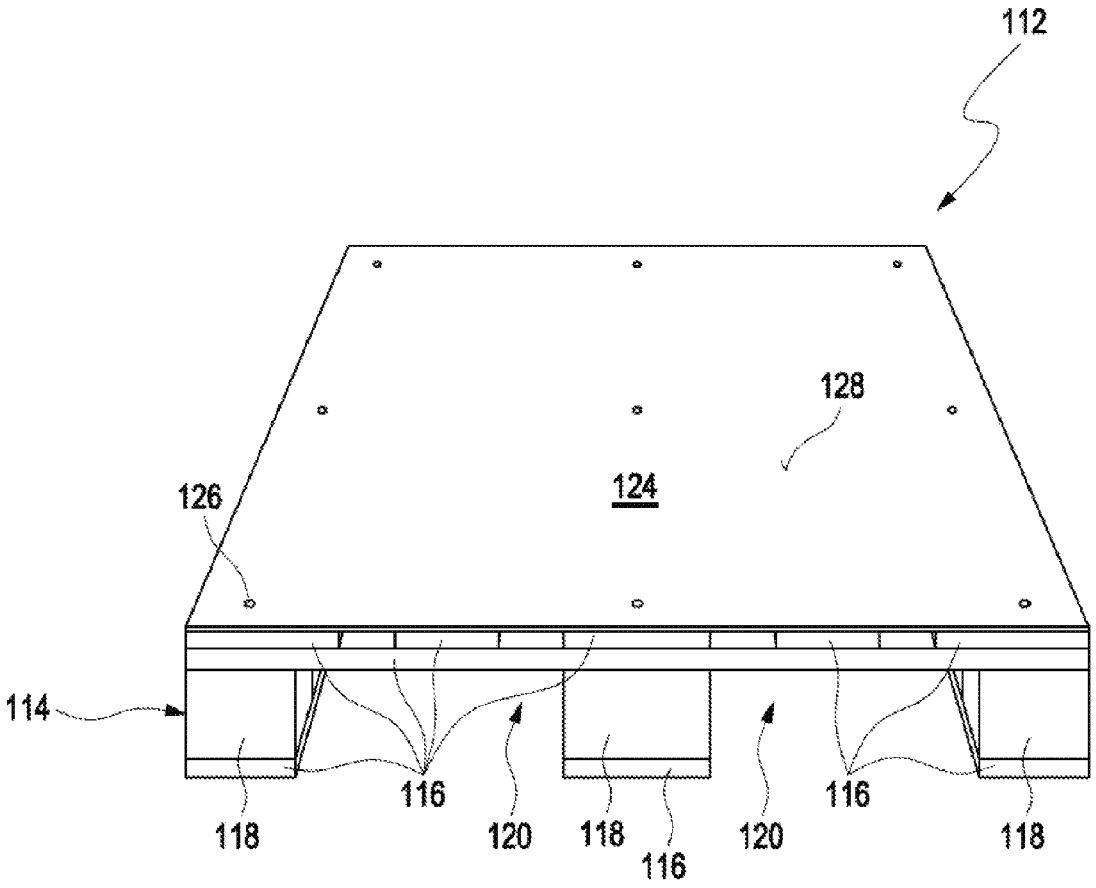
FIG. 1 shows an exemplary embodiment of a pallet which can be used according to the invention with an even base plate.

A pallet 112 is prepared in a first method step shown in FIG. 1. Said pallet 112 includes a timber pallet 114, which can also be seen again in more detail in following FIGS. 2 and 3. In all, the pallet 112 can be developed, for example, as a four-way flat pallet and can correspond overall with regard to the technical designs to a Euro pallet and/or a World pallet. For example, corresponding standards, for example UIC standard 435-2, can be taken into consideration with regard to the timber requirements, the timber tolerances, the nail pattern and the fastening elements. It is possible for said standards to be provided with certain restrictions. Thus, the thickness of the top pallet boards 116 used in the case of the timber pallet 114 can be, for example, 21 mm, whereas the named UIC standard requires a minimum of 22 mm in this respect.

The timber of the timber pallet 114 can be pre-treated, for example corresponding to usual standards such as, for example, the IPPC standard. For example, said pre-treatment can avoid harmful organisms being brought in with the packaging material of the transport packaging unit. For example, the timber can be de-barked. As an alternative to this or in addition to it, the timber can have been sterilized for example by at least one treatment, for example by a chemical and/or thermal treatment. For example, a treatment can have been effected in the form of a sterilizing gas treatment, for example by means of methyl bromide. As an alternative to this or in addition to it, heating can be effected. The timber pallet 114 can include at least one corresponding marking which can specify the type of treatment, for example by means of at least one so-called IPPC symbol. As an alternative to this or in addition to it, the timber pallet can comprise one or several further markings, for example a Euro pallet marking and/or a marking of a shipper such as, for example, the Deutsche Bahn and/or a quality marking such as, for example, the European Organization for Quality-Assured Euro pallets. The timber of the timber pallet 114 can preferably be developed fully without splintering or other damage to the timber. The timber pallet 114 can additionally comprise blocks 118 as shown in the figures. In addition, the timber pallet 114 or the framework formed by said timber pallet 114, as can be seen in particular in FIG. 2, can comprise two or more openings 120 for the engagement of a fork 122 of a fork lift truck and/or lift truck.

A base plate 124, which is preferably developed in an even and closed manner, is mounted onto the timber pallet 114. The base plate 124 is developed, for example, in a rectangular manner and preferably closes off flush with the timber pallet 114. The base plate 124 is fastened on the timber pallet 114 for example by means of fastening elements 126, in particular nails and/or screws.

The base plate 124 is developed, for example, as a hard particle board. The hard particle board can include in particular a smooth and a corrugated side. The smooth side can in particular be facing the timber pallet 114 such that the corrugated side can serve as a non-slip surface 128 of the pallet 112. The base plate 124, in particular the hard particle board, can comprise in particular a thickness of 3 mm and can be cut at the corners preferably identically to the timber pallet 114, for example by means of a corner cut. The base plate 124 can be fixed, for example nailed, for example by means of 9 fastening elements 126. The hard particle board can comprise, for example, a width of 800 mm+/−4 mm and a length of 1200 mm+/−4 mm. The thickness of 3 mm can comprise, for example, a tolerance of +/−1 mm, preferably of not more than +/−0.5 mm. The fastening elements 126 can be, for example, nails with a length of 20 mm.

FIG. 2 shows simultaneously the result of a second method step (method step b)) and a third method step (method step c)). Thus, in a second method step articles to be transported 130 are placed onto the base plate 124. For example, said articles to be transported 124, as can be seen in FIG. 2, can include a multitude of packing items, for example cuboid packing items. Said articles to be transported can be stacked on the pallet 112 at a spacing to the edge of the pallet 112 such that preferably a cuboid stack is created. In addition, at least one intermediate element, for example a foil-shaped intermediate element 132, for example at least one insert sheet from a paper material and/or at least one foil element in the form of a plastic foil, can be inserted between the articles to be transported 130 and the surface 128 of the base plate 124, as can be seen as an option in FIG. 2. Other developments are also possible. As an option, the articles to be transported 130 can also be placed directly onto the surface 128.

In a method step which can also be seen in FIG. 2, a transport box 134 which is open toward the base plate 124 is inverted over the articles to be transported 124. Said transport box 134 can be developed, for example, as a sleeve or as a collar, with an area which is preferably also rectangular and corresponds preferably in a precise fitting manner to the area of the base plate 124. The transport box 134 can be developed, for example, as shown in FIG. 2, as a part folding box 136 which is open toward the base plate 124 and which comprises a closable opening 138 on an end remote from the base plate. Said closable opening 138 can be closable for example by means of one, two, three, four or more folding flaps 140 which can be folded inward in order to close the opening 138 in a closure step.

The transport box 134 can be produced for example as a part folding box from a cardboard material. For example, a double-layered corrugated board part folding box can be used. For example, a corrugated board material with an outer sheet with a density of 280 g/m$^2$ and an inner sheet with a density of also 280 g/m$^2$ can be used. A C-flute, an intermediate sheet and an A-flute can be developed inside said outer sheet and said inner sheet. The C-flute can comprise, for example, a density of 125 g/m$^2$ and the A-flute a density of 150 g/m$^2$. The intermediate sheet can comprise, for example, a density of 170 g/m$^2$. Other developments are also possible in principle.

The transport box 134, in particular the part folding box 136, can comprise, for example, a wall thickness of 14 mm. In addition, said transport box can comprise, for example, a length of 1151 mm, a width of 771 mm and a height of 745 mm. Other dimensions, however, are also possible in principle. The part folding box 136 can be closed, for example, by stitching, i.e. made to form a sleeve. In addition, the part folding box 136, as can be seen for example in FIG. 4, can be provided on an outside surface with one, two or several markings 142 prior to or after packing. In this way a hazardous materials marking, for example, can be effected and/or product information and supplier information can be attached.

Once the transport box 134 has been inverted over the articles to be transported 130, in an interior 144 in one or two directions in space on one, two, three or four sides of the articles to be transported 130 there remains a space 146 preferably between the articles to be transported 130 and the walls of the transport box 134. Said space 146 in said exemplary embodiment or also in other exemplary embodiments can be filled out completely or in part by way of one or several further packing means. It is particularly preferred when, as shown in FIG. 3, one or several spacers 148 are inserted into said space 146.

The spacer or spacers 148 can also be produced preferably from a cardboard material. For example, it is possible to use rectangular spacers which comprise a thickness of 40 mm, a length of 740 mm and a width of 570 mm. Said rectangular spacers can be produced and folded from a corrugated board blank, as indicated in FIG. 3. The corrugated board blank can comprise, for example, a material thickness of 7 mm.

The spacers 148 can serve for stabilizing the articles to be transported 130 in the interior 144 and can serve in particular for the purpose of preventing individual packing items of the articles to be transported 130 falling out of the stack. An additional fixing of the articles to be transported 130 inside the interior 144 is, as a rule, not necessary. Thus, a modification and/or a foil wrapping of the packing items of the articles to be transported 130 can be dispensed with in principle, for example, in the case of said exemplary embodiment and also in the case of other exemplary embodiments. Thus, in general, individual packing items of the articles to be transported 130 can simply be stacked in the interior 144 without an additional fixing which includes the stack being necessary.

In a further method step, for example after carrying out the method steps in FIGS. 2 and 3, the opening 138 can then be closed, for example by folding over the folding flaps 140. Said folding flaps can be secured additionally, as can be seen in FIG. 4, by, for example, an adhesive strip 150.

In addition, the transport box 134 can be fixed on the base plate 124, one or several fastening elements 152 being able to be used. In particular, at least one packing strip 154 can be used, in this case, as a fastening element 152. Said packing strips can surround the pallet 112 and the transport box 134. In this case, a bottom edge 156 of the transport box 134 can be pressed onto the base plate 124 and the surface thereof 128 such that the interior 144 is sealed off.

Harnessing by means of the optional packing strips 154, it being possible to use four packing strips 154 for example, can preferably be effected simply with one direction of winding, as shown in FIG. 4. For example, as shown in FIG. 4, cross harnessing can be effected exclusively, with a winding axis of the packing strips 154 which is parallel to a longer side edge of the base plate 124.

A transport packaging unit 110 as shown in FIG. 4 which is suitable as a large packaging unit to transport hazardous materials can be created in particular in this manner. In particular, said transport packaging unit 110 can correspond to the Ordinance Concerning the Carriage of Dangerous Goods by Road, Rail and Inland Waterways in the Federal Republic of Germany and the Ordinance Concerning the Carriage of Dangerous Goods by Sea in the Federal Republic of Germany.

LIST OF REFERENCES

110 Transport packaging unit
112 Pallet
114 Timber pallet
116 Pallet boards
118 Blocks
120 Opening
122 Fork
124 Base plate
126 Fastening element
128 Surface
130 Articles to be transported
132 Intermediate element
134 Transport box
136 Part folding box
138 Opening
140 Folding flaps
142 Marking
144 Interior
146 Space
148 Spacer
150 Adhesive strip
152 Fastening element
154 Packing strip
156 Edge

The invention claimed is:

1. A transport packaging unit for packaging articles to be transported, wherein the transport packaging unit comprises the following:

a standard pallet with a base plate coupled thereto, wherein the articles to be transported are directly receivable on the base plate, wherein the base plate is developed so as to be even and forms a plate-shaped element which is developed in a completely even manner and is liquid-tight when coupled to the pallet;

a transport box which is open toward the base plate, wherein the transport box rests on the base plate and together with the base plate forms an interior of the transport packaging unit which receives the articles to be transported, wherein the transport box is placed onto the base plate in the form a sleeve or a collar, wherein the transport box comprises an opening which is closable by means of folding flaps on a side opposite the base plate, wherein the transport box closes off in a flush manner with the pallet at the sides, wherein the transport box is fixed on the base plate by a packing strap that runs through the pallet when the transport box is coupled to the pallet; and wherein the base plate is a puncture resistant hard particle board having a thickness of between 1 and 10 mm and wherein the transport box is produced from corrugated board.

2. The transport packaging unit as claimed in claim 1, wherein the base plate and the transport box close off the interior in a tight manner.

3. The transport packaging unit as claimed in claim 1, wherein the transport box closes off flush with the pallet at the sides.

4. The transport packaging unit as claimed in claim 1, wherein the transport box is produced from a cardboard material.

5. The transport packaging unit as claimed in claim 1, wherein the transport box is realized as a part folding box.

6. The transport packaging unit as claimed in claim 1, wherein at least one spacer is received in the interior between the articles to be transported and at least one inside wall of the transport box.

7. The transport packaging unit as claimed in claim 1, wherein the transport box comprises an opening which is closable by means of folding flaps.

8. The transport packaging unit as claimed in claim 1, wherein:

the base plate couples to the pallet via a fastening element; and the transport packaging unit further includes a sealing element between the fastening element and the base plate.

9. The transport packaging unit as claimed in claim 1, wherein the plate-shaped element is without an elevated edge and is without protruding elements.

10. The transport packaging unit as claimed in claim 1, wherein the transport packaging unit is independent of an intermediate element inserted between the transport box and the base plate.

11. The transport packaging unit as claimed in claim 10, wherein at least one spacer is received in the interior between the articles to be transported and at least one inside wall of the transport box, wherein the at least one spacer is independent of the package.

12. The transport packaging unit as claimed in claim 1 further including an intermediate element inserted between the transport box and the base plate.

* * * * *